US005834119A

United States Patent [19]

Roop

[11] Patent Number: 5,834,119

[45] Date of Patent: Nov. 10, 1998

[54] FILAMENT CROSS-SECTIONS

[75] Inventor: Robert Kenneth Roop, Greenville, N.C.

[73] Assignee: E. I. du Pont de Nemours and Company, Wilmington, Del.

[21] Appl. No.: 778,462

[22] Filed: Jan. 3, 1997

[51] Int. Cl.[6] ..... D02G 3/00

[52] U.S. Cl. ..... 428/397; 428/399; 428/401

[58] Field of Search ..... 428/397, 399, 428/401

[56] References Cited

U.S. PATENT DOCUMENTS

| | | | |
|---|---|---|---|
| 3,156,607 | 11/1964 | Strachan | 161/177 |
| 3,914,488 | 10/1975 | Gorrafa | 428/397 |
| 4,316,924 | 2/1982 | Minemura et al. | 428/89 |
| 4,634,625 | 1/1987 | Franklin | 428/258 |
| 4,707,407 | 11/1987 | Clark et al. | 428/361 |
| 5,591,523 | 1/1997 | Aneja | 428/397 |
| 5,626,961 | 5/1997 | Aneja | 428/397 |

FOREIGN PATENT DOCUMENTS

| | | |
|---|---|---|
| 4-119118 | 4/1992 | Japan . |

*Primary Examiner*—Newton Edwards

[57] ABSTRACT

A new polyester fiber is provided with an improved scalloped-oval cross-section, such as provides a surprising combination of advantages in downstream products, such as fabrics and garments.

1 Claim, 2 Drawing Sheets

FILAMENT CROSS-SECTIONS

FIELD OF INVENTION

This invention relates to improvements in filament cross-sections, and is more particularly concerned with new polyester filaments having an improved scalloped-oval cross-section, and being such as is especially useful in velour fabrics, and to processes relating thereto and products therefrom, and having other advantages.

BACKGROUND OF THE INVENTION

Yarns of synthetic fibers, such as polyester fibers, can generally be classified into two groups, namely (1) continuous filament yarns and (2) spun yarns, meaning yarns of fibers that are discontinuous, which latter fibers are often referred to as staple fibers (sometimes as cut fibers). Polyester staple fibers and such fibers of other synthetic polymers are formed by extrusion of the synthetic polymer into continuous filaments, which are then converted into staple fibers. The terms "fiber" and "filament" are often used herein inclusively, without intending that use of one term should exclude the other.

Velour fabrics can be produced by several processes, including knitting and weaving, but all have the characteristic that they comprise cut fibers that stand on end. The cut fibers are typically short, 0.06 to 0.25 inches (1.5 to 7 mm) and are held upright from the backing fibers. Velours are frequently used in home upholstery, automotive upholstery and apparel applications.

Automotive upholstery velours require increased performance and improved aesthetics. Performance criteria for velour fabrics include reduced propensity to crush while desired aesthetics include softer hand and no "fingermarking" or "mark-off". Improvements in all these fabric parameters typically require fiber properties that are difficult to include in one and the same fiber; in other words, improving desired performance may decrease desired aesthetics and vice versa.

One means to vary the performance and aesthetic properties of the fabric is by varying fiber size. For example, a 1 denier-per-filament (dpf and approximately corresponding to 1 dtex) round polyester filament fiber can be used to make an automotive velour fabric to provide a very soft hand. However, the fingermarking aesthetics and crush performance of such a fabric have been unacceptable. Conversely, a 5 dpf (about 5.5 dtex) round polyester filament can be used to make an automotive velour with very good crush performance and fingermarking aesthetics, but has had unacceptable hand. As a result, the industry standard has been 2.2 to 3 dpf (2.4 to 3.3 dtex) round filaments; these, however, have provided neither adequate fabric performance nor desired aesthetics. Other common fiber cross-sections such as octalobal (U.S. Pat. No. 4,041,689) and triangular (trilobal, U.S. Pat. No. 3,698,177) have provided only limited improvements.

According to this invention, and described and illustrated hereinafter, I provide a synthetic polymeric filament, especially a polyester filament, that improves the performance characteristics of velour fabrics, namely reduced crushing propensity, while also improving the aesthetics of such velour fabrics, namely reduced fingermarking and softer hand.

SUMMARY OF THE INVENTION

According to one aspect of the invention, there is provided a filament having a scalloped-oval peripheral cross-section that is of aspect ratio (A:B) about 3:1 to 1.1:1, B being maximum width and A being measured along major axis of the scalloped-oval peripheral cross-section, and having 8 grooves extending along the filament, 4 of said 8 grooves being located on each side of the major axis, wherein 4 of said 8 grooves are located towards ends of the major axis and are referred to herein as outer grooves, wherein a pair of said outer grooves that are located at the same end of the major axis define between them a lobe at the same end of the major axis and are separated from each other by a minimum distance between said pair of $d_1$, the width of the cross-section as measured at the lobe being $b_1$, wherein remaining 4 of said 8 grooves that are not outer grooves are referred to herein as inner grooves, each of said inner grooves being located between one of said outer grooves and location of said maximum width, wherein pairs of said inner grooves that are separated from each other by the major axis are separated by a minimum distance between them of $d_2$, wherein 4 outer bulges in the scalloped-oval peripheral cross-section are defined by being between one of said outer grooves and one of said inner grooves, the width of the cross-section as measured at such outer bulges being $b_2$, wherein inner bulges in the scalloped-oval peripheral cross-section between 2 of said inner grooves on a side of the major axis provide the location for said maximum width B, and wherein the numerical relationships between the widths B, $b_1$ and $b_2$ and the distances $d_1$ and $d_2$ are as follows: $d_1/b_1$ is about 0.5 to about 1; $d_2/b_2$ is about 0.5 to about 0.9; $d_2/B$ is about 0.3 to about 0.7; $b_1/b_2$ is about 0.25 to about 0.9; and $b_2/B$ is about 0.5 to about 0.9. This improved cross-sectional configuration with 8 grooves is often referred to herein as "scalloped-oval" and as 8-grooved or as "octachannel". As indicated, the term "filament" is used inclusively herein. The term is used to include both continuous filaments and cut fibers. The essence of the invention is in the new filament cross-section that has provided unexpected advantages, as will be described.

This invention is primarily addressed to solving problems encountered in providing polyester fibers for velour fabrics, as already indicated. However, the advantages of the unique cross-sectional configuration of my new filaments may well also be adaptable to other synthetic filaments, e.g., of polyamides or polyolefins, by way of example, and to other applications.

According to another aspect of the invention, downstream products, such as fabrics and garments, are also provided.

According to further aspects of the invention, there are provided processes for preparing the new filaments and other products.

DETAILED DESCRIPTION OF PREFERRED EMBODIMENT

As indicated, the essence of my invention is in the new filament cross-section, so this will be primarily addressed.

The cross-sections of the polyester filaments according to my invention should not be round but scalloped-oval, i.e., generally oval in shape with scallops (i.e., with indentations) in the generally oval periphery so as to provide 8 grooves (channels) that run along the length of the filaments. Twenty years ago, a polyester filament of scalloped-oval cross-section was disclosed by Gorrafa in U.S. Pat. No. 3,914,488, the disclosure of which is hereby expressly incorporated herein by reference, as is the disclosure of Franklin U.S. Pat. No. 4,634,625 and Clark et al. U.S. Pat. No. 4,707,407 which disclose filaments of similar scalloped-oval cross-section for use in continuous filament yarns and staple. Also, Aneja has filed copending applications Ser. Nos. 08/662,804 (DP-6400) on Jun. 12, 1996, 08/497,495 (DP-6255) on Jun. 30, 1995, and shortly to issue as U.S. Pat. No. 5,591,523, and 08/642,650 (DP-6365-A) on May 3, 1996, now allowed, the disclosures of which are also incorporated herein by reference. My 8-grooved scalloped-oval cross-section is clearly different from the 4-grooved and 6-grooved scalloped-oval cross-sections disclosed by Gorrafa, Franklin, Clark et al., and Aneja. My filaments provide advantages over those filaments having different scalloped-oval cross-sections, which are surprising.

The essence of the present invention is the cross-sectional shape or configuration of my new filaments that results mainly from selection of appropriately-shaped polymer extrusion orifices, as discussed in the art, although other factors, such as the polymer viscosity and the spinning conditions, also affect the shape of the filaments. This will now be discussed with reference to the accompanying Drawings. The cross-sectional configuration of filaments according to the invention may be seen in FIG. 1 which is a photomicrograph (2000×) showing actual filament cross-sections as prepared in the Example.

Figure 2:
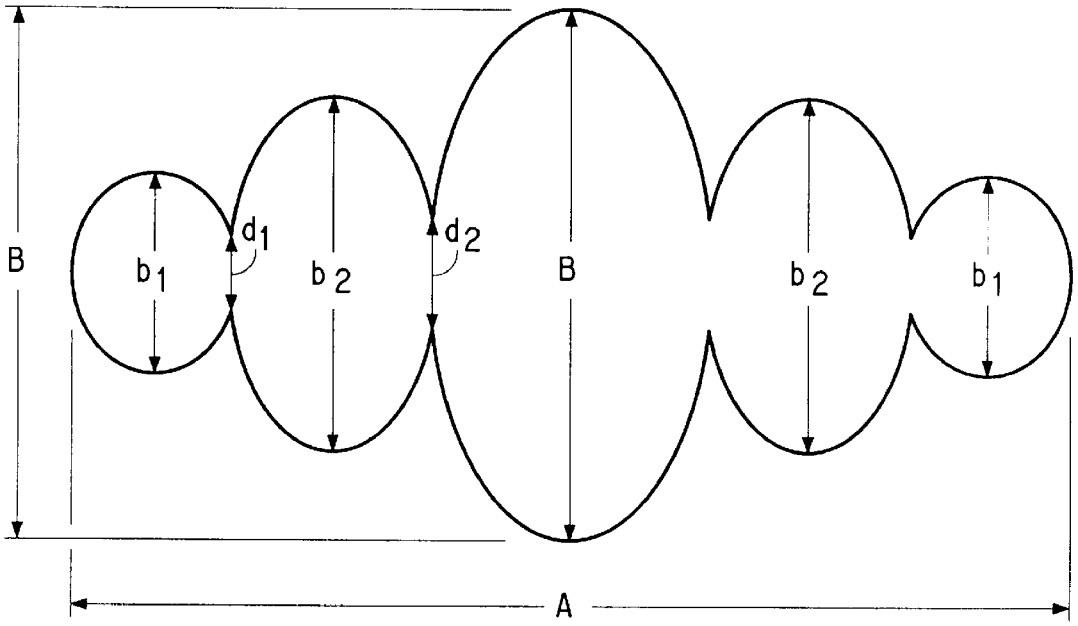
FIG. 2 is a schematic representation of such a cross-section to illustrate calculations of dimensions.

FIG. 2 is a schematic representation of a typical octachannel cross-section for ease of discussing dimensions that are significant. The largest dimension A of the periphery of the fiber cross-section is shown extending along the major axis. The maximum width (B) of the fiber cross-section extends at right angles to the major axis. The ratio of A to B is referred to as the aspect ratio (A/B). This aspect ratio should generally be up to about 3:1, and at least about 1.1:1 (corresponding to a B/A ratio of about 0.35 to about 0.9); a preferred aspect ratio has been found to be about 2:1. As can be seen, the cross-section has a generally oval periphery that is indented and is to this extent somewhat similar to the prior scalloped-oval cross-sections disclosed by Gorrafa and others. Unlike Gorrafa's 4-groove scalloped-oval, however, this periphery has eight (8) indentations (which correspond with 8 channels, or grooves, that extend along the filament length). Four (4) grooves (indentations) are located on either side of the cross-section, i.e., on each side of the major axis. Four (4) of the eight grooves (indentations) are referred to as "outer" grooves (indentations) as they are located towards the ends of the major axis, so a pair of these outer grooves is located, one on either side of, near each end and this pair defines a lobe at each end. This lobe is of width $b_1$, measured generally at right angles to the major axis. Such a pair of outer grooves at the same end of the major axis is separated one from the other by a distance $d_1$, also shown as being in a direction at right angles to the major axis because the grooves are shown symmetrically located. It will be understood that if the indentations are not opposite one another the separation distance $d_1$ will not be precisely perpendicular to the major axis. The remaining grooves on either side of the major axis are located between these outer grooves and are referred to accordingly as "inner" grooves (indentations). Between grooves (in the generally oval (i.e., generally convexly-curved) periphery that are adjacent along a side of the cross-section) are what are referred to herein as "bulges"; these may be considered somewhat similar to what Gorrafa referred to as his lobes that he located on each extremity of his minor axis, but are probably more correctly termed bulges than lobes. Because preferred filaments of the present invention are octachannel filaments, whose cross-sections have eight (8) grooves, in contrast to Gorrafa's four (4), my cross-sections have four (4) grooves on either side and three (3) bulges on either side; for convenience, these three bulges on either side are referred to as "outer bulges" and "inner bulges", the latter being the middle of each set of 3 bulges on either side and being between both of the inner grooves on the same side, whereas each "outer bulge" is between an outer groove and its nearest inner groove on the same side. The width of the filament cross-section at the outer bulges is designated $b_2$ (corresponding to the width of a lobe, namely $b_1$) and a pair of inner grooves is separated from each other (across the major axis) by $d_2$ (corresponding to the separation between a pair of outer grooves by distance $d_1$). As will be understood, the maximum width at the bulges is B, namely the maximum width of the filament cross-section, generally being the width of the inner bulges.

The numerical relationships of the foregoing parameters should be approximately as follows:

A/B-3 to1.1-preferably 2;

$d_1/b_1$-0.5 to 1.0-preferably 0.8;

$d_2/b_2$-0.5 to 0.9 -preferably 0.7;

$d_2$/B-0.3to0.7-preferably 0.5;

$b_1/b_2$ -0.25to0.9 -preferably 0.5;

$b_2$/B-0.5 to0.9-preferably 0.75.

Various alternative octachannel cross-sections can be envisaged for filaments of this invention. Although the cross-section shown schematically in FIG. 2 is more or less symmetrical, and this is preferred for some embodiments, it is not essential. For instance, the indentations need not be symmetrically located opposite each other on either side of the filament. Also, the distances and widths need not be the same but may vary within the limits indicated generally, as an average, herein.

Figure 3:
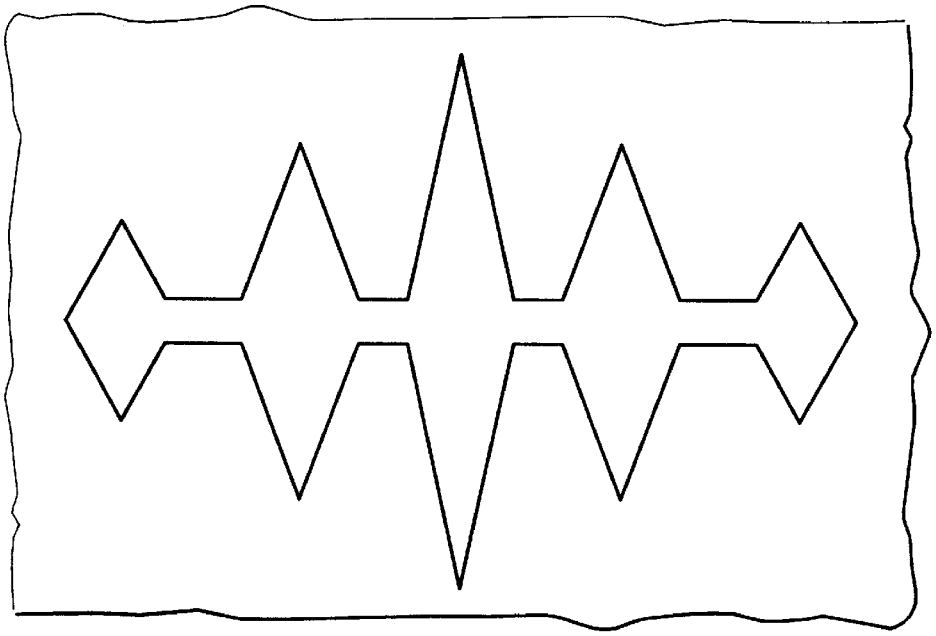
FIG. 3 is a schematic representation of a preferred spinneret capillary orifice used to spin filaments of the invention.

A preferred spinneret capillary orifice for preparing filaments of the invention is shown in FIG. 3 and is described in greater detail in copending application Ser. No. 08/778,458 (DP-6555) filed Jan. 3, 1997 simultaneously herewith by Aneja and myself, and in the Example hereinafter, as are other details of processes of preparation. Reference should be made to copending Application Ser. No. 08/778,458 (DP-6555) for directions how to measure widths (H) and flow areas (A) of diamond-shaped apertures as the sides of the diamonds are extrapolated until they meet within the slots between such apertures and, similarly, for the ratios a/A and h/H. However, the lengths measured along the row as given herein in the Example were measured to the midpoint of each slot between the apertures. The length of the slots was measured to where they intersected with the diamonds.

Variations in the polymers and filaments, and in their preparation and processing will often depend on what is desirable in downstream products, such as fabrics and garments. Aesthetic considerations are very important in apparel and other textile applications.

This invention is further illustrated in the following Example, in which velour fabrics made from yarns of filaments of the invention are compared with comparable fabrics made from yarns of filaments of other cross-sections. All parts and percentages are by weight, unless otherwise indicated. Partially oriented continuous filament yarn (POY) was produced and draw-textured as such yarns are preferred for making yarns for velour fabrics, (although the invention is not restricted thereto, and is applicable to fully oriented yarn, for example, and to spinning filaments for making staple, and resulting staple). Similarly, fabric samples were made as a woven velour (although a knit velour would also be acceptable for the invention) through standard fabric-forming techniques. The draw-textured yarn deniers were the same (150 denier, equivalent to 167 dtex) so that fabric weights were equivalent. The individual deniers-per-filament (dpf) were, however different, as they were adjusted to obtain optimum balance of the competing fabric properties for each filament cross-section.

The fabrics were subjectively rated for hand (softness), fingermarking, and crush resistance. The rating for hand was on a scale of 1 to 5, 5 being the best and 1 being the worst; as a frame of reference, a fabric made with 1 denier-per-filament (dpf corresponding to 1.1 dtex) fiber with a round cross section was rated a 5 and a fabric made with a 5 dpf (5.5 dtex) round fiber was rated a 1. The rating for fingermarking was on a scale of 1 to 5, 5 having little or no fingermarking, 3 having acceptable fingermarking, and 1 having terrible fingermarking. The crush resistance ratings were based on a standard accelerated crush test known as the Rolling Sphere. This test subjects the fabric to repetitive mechanical stroking with a steel ball. The fabrics are then rated on a scale of 1 to 5, 5 having little or no crush mark showing, 3 having acceptable crush appearance, and 1 having terrible crush marking. Samples are rated typically by five people and the ratings reported as the average of the five scores.

Example

Filaments of poly(ethylene terephthalate) were melt-spun at 295° C. from polymer having a relative viscosity (LRV of 21 and titanium dioxide ($TiO_2$) content of 1.5% as a delusterant. The polymer was extruded at a rate of 11.1 pounds (5.0 Kg) per hour through spinnerets having the numbers of capillaries and cross-sections as shown in Table 1.

Figure 1:
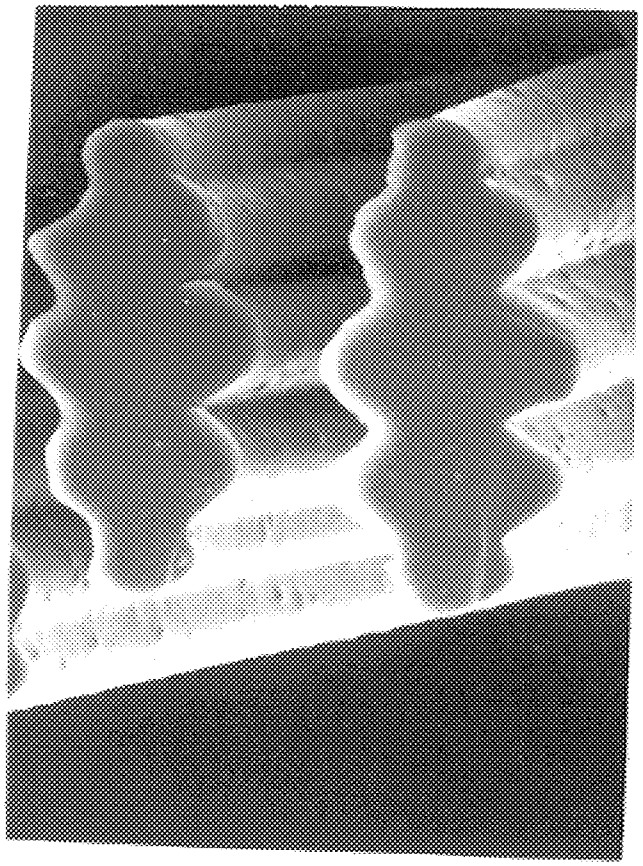
FIG. 1 is a magnified (2000×) photograph of a preferred embodiment of filaments of the invention that have been cut to show their unique cross-sections, as well as part of their filament length, as discussed in more detail hereinafter.

FIG. 3 shows the capillary orifice used to produce the octachannel scalloped-oval filaments of the present invention. As shown in FIG. 3, the capillary for the octachannel fiber consisted of five diamonds joined by slots to obtain a well-defined filament shape, good spinning performance and low fiber fibrillation propensity. The widths (H) of the small, medium, and large diamond-shaped apertures were 13.6 mil (345$\mu$), 24 mil (610$\mu$), and 35.8 mil (909$\mu$), respectively. The small, medium, and large diamond included angles were 60°, 40°, and 26°, respectively. All five diamonds were located in a straight row. The overall length of the orifice along the row was 52.6 mil (1336$\mu$). The lengths measured along the row (as mentioned above) were, in order, 9.1 mil (231$\mu$), 11.2 mil (284$\mu$), 12 mil (305$\mu$), 11.2 mil (284$\mu$), and 9.1 mil (231$\mu$), respectively. The 4 slots between the diamond-shaped apertures were each of length 3.5 mil (89$\mu$) and width (h) 2.6 mil (66$\mu$). The capillary yielded $a_1/A_1$, $a_1/A_2$, $a_2/A_2$, and $a_2/A_3$ flow area ratios of 0.11, 0.05, 0.08, and 0.06, respectively. The ratios $h/H_1$, $h/H_2$, and $h/H_3$ were 0.19, 0.11, and 0.07, respectively. Filaments produced from the 50 hole spinneret in FIG. 3 of the present invention were wound at 3131 meters per minute (mpm) after being quenched using standard POY cross flow quench. The bundle of filaments of the invention wound-up was 255 denier (283 dtex) and had a draw tension of approximately 93 gpd (grams per denier, about 84 g/dtex). The filaments had octachannel cross-sections (as shown in FIG. 1) with the following parameters:

$A/B=2$ $d_1/b_1=0.9$ $d_2/b_2=0.67$ $d_2/B=0.47$ $b_1/b_2=0.53$ $b_2/B=0.65$

Winding speeds (mpm) and draw tensions (gpd) are given for all the cross-sections in Table 1. Each end was subsequently draw-false-twist textured (drawn dpfs being also given in Table 1), package dyed, air jet entangled, woven into a woven velour fabric, and finished using standard fabric finishing techniques. The fabric samples were rated for hand, fingermarking, and crush resistance (as described above). The results of the ratings are shown in Table 2.

TABLE 1

| Cross section | # of Capillaries | dpf | Winding Speed | Draw Tension |
|---|---|---|---|---|
| Round | 68 | 2.2 | 3242 | 95 |
| Ribbon | 40 | 3.75 | 3395 | 93 |
| Ribbon/Scalloped Oval/ Octalobal mixture | 50 | 3.0 | 3273 | 94 |
| Mixed dpf Octalobal | 69 | 2.2 (avg.) | 3053 | 92 |
| Mixed dpf Round | 68 | 2.2 (avg.) | 2943 | 93 |
| Ribbon/Round mixture | 68 | 2.2 | 3071 | 95 |
| Octachannel | 50 | 3 | 3131 | 93 |

TABLE 2

| Cross section | Hand | Fingermarking | Crush Resistance |
|---|---|---|---|
| Round | 1.9 | 2.6 | 2.6 |
| Ribbon | 2.5 | 3.6 | 3.2 |
| Ribbon/Scalloped Oval/ Octalobal mixture | 2.9 | 3.7 | 3.4 |
| Mixed dpf Octalobal | 3.3 | 2.5 | 3.0 |
| Mixed dpf Round | 2.8 | 2.2 | 3.2 |
| Ribbon/Round mixture | 2.6 | 2.2 | 3.2 |
| Octachannel | 3.8 | 3.5 | 3.4 |

The octachannel cross-section of the invention provided the best combination of hand, fingermarking, and crush resistance versus the other cross-sections, demonstrating that the filaments of the invention provided a superior combination of properties that are desired in such velour fabrics. It is believed that the novel octachannel cross-section will also show advantages in other applications, e.g., as disclosed by Aneja in his applications referred to hereinabove, such as tows and slivers for worsted and woollen processing.

I claim:

1.A filament having a scalloped-oval peripheral cross-section that is of aspect ratio (A:B) about 3:1 to 1.1:1, B being maximum width and A being measured along major axis of the scalloped-oval peripheral cross-section, and having 8 grooves extending along the filament, 4 of said 8 grooves being located on each side of the major axis, wherein 4 of said 8 grooves are located towards ends of the major axis and are referred to herein as outer grooves, wherein a pair of said outer grooves that are located at the same end of the major axis define between them a lobe at the same end of the major axis and are separated from each other by a minimum distance between said pair of $d_1$, the width of the cross-section as measured at the lobe being $b_1$, wherein remaining 4 of said 8 grooves that are not outer grooves are referred to herein as inner grooves, each of said inner grooves being located between one of said outer grooves and location of said maximum width, wherein pairs of said inner grooves that are separated from each other by the major axis are separated by a minimum distance between them of $d_2$, wherein 4 outer bulges in the scalloped-oval peripheral cross-section are defined by being between one of said outer grooves and one of said inner grooves, the width of the cross-section as measured at such outer bulges being $b_2$, wherein inner bulges in the scalloped-oval peripheral cross-section between 2 of said inner grooves on a side of the major axis provide the location for said maximum width B, and wherein the numerical relationships between the widths B, $b_1$ and $b_2$ and the distances $d_1$ and $d_2$ are as follows: $d_1/b_1$ is about 0.5 to about 1; $d_2/b_2$ is about 0.5 to about 0.9; $d_2/B$ is about 0.3 to about 0.7; $b_1/b_2$ is about 0.25 to about 0.9; and $b_2/B$ is about 0.5 to about 0.9.

* * * * *